US009599438B1

(12) United States Patent
Fravor et al.

(10) Patent No.: US 9,599,438 B1
(45) Date of Patent: Mar. 21, 2017

(54) RAIL ADAPTER FOR MOUNTING OVER THE REAR SIGHT OF AN AK TYPE RIFLE

(71) Applicant: Otis Products, Inc., Lyons Falls, NY (US)

(72) Inventors: John P. Fravor, Pulaski, NY (US); Christopher Ashley, Liverpool, NY (US)

(73) Assignee: Otis Products, Inc., Lyons Falls, NY (US)

( * ) Notice: Subject to any disclaimer, the term of this patent is extended or adjusted under 35 U.S.C. 154(b) by 0 days.

(21) Appl. No.: 14/837,878

(22) Filed: Aug. 27, 2015

(51) Int. Cl.
*F41G 11/00* (2006.01)
*F41G 1/387* (2006.01)

(52) U.S. Cl.
CPC ..... *F41G 11/003* (2013.01)

(58) Field of Classification Search
CPC ..... F41G 11/003; F41G 11/004; F41G 11/00
USPC ..... 42/127, 90, 125, 124
See application file for complete search history.

(56) References Cited

U.S. PATENT DOCUMENTS 6,418,657 B1 7/2002 Brown
7,062,876 B2 * 6/2006 Wilson ..... F41G 11/001 42/125
8,156,678 B2 4/2012 Hoel et al.
8,196,332 B2 * 6/2012 Brentzel ..... F41G 11/003 42/124
8,240,075 B1 8/2012 Mullin
8,522,469 B2 9/2013 Baker
2010/0175295 A1 * 7/2010 Hoel ..... F41G 11/003 42/90
2012/0131838 A1 5/2012 Edge et al.
2014/0068994 A1 * 3/2014 Schultz ..... F41G 11/003 42/124
2014/0237880 A1 8/2014 Clifton
2015/0345901 A1 * 12/2015 Cheng ..... F41C 33/08 42/111

OTHER PUBLICATIONS

ISA/US International Search Report and Written Opinion for corresponding International Application No. PCT/US2016/048334, date of mailing Nov. 10, 2016 (8 pgs).

* cited by examiner

*Primary Examiner* — Reginald Tillman, Jr.
(74) *Attorney, Agent, or Firm* — Harris Beach PLLC

(57) ABSTRACT

A removable rail for mounting over an AK iron sight assembly of an AK type rifle includes a pair of brackets that fit outer side surfaces of an AK iron sight assembly. At least one pressure clamp is disposed on a side of at least one bracket of the pair of brackets. When the pressure clamp is in an open position, the pair of brackets can be slid over the AK iron sight assembly for mounting or for removal. When the pressure clamp is in a closed position, the pair of brackets are held in a non-moving engagement with the outer side surfaces of the AK iron sight assembly. A fixed AK rail, another type of AK rail, and a method for adding a small arms accessory rail system to an AK rifle by mounting a rail over an AK iron sight assembly are also described.

16 Claims, 12 Drawing Sheets

RAIL ADAPTER FOR MOUNTING OVER THE REAR SIGHT OF AN AK TYPE RIFLE

FIELD OF THE APPLICATION

The application relates to a small arms weapon accessory rail system and particularly to an accessory rail system for AK type rifles.

BACKGROUND

The Picatinney accessory mounting rail for AR type rifles is available in a variety of styles. Accessories which can be mounted on a Picatinney include, for example, advanced sights which replace the traditional iron sights. The Picatinney rail is named for the U.S. Army Picatinney Arsenal and has been described in U.S. Military standards, such as MIL-STD-1913 (AR).

SUMMARY

According to one aspect, a removable rail for mounting over an AK iron sight assembly of an AK type rifle includes at least one rail having a first end and a second end. A pair of brackets extends from an underside of the first end of the rail forming a rectangular opening adapted to closely fit the outer side surfaces of an AK iron sight assembly. At least one pressure clamp is disposed on a side of at least one bracket of the pair of brackets. When the pressure clamp is in an open position, the pair of brackets can be slid over the AK iron sight assembly for mounting or for removal. When the pressure clamp is in a closed position, the pair of brackets are held in a non-moving engagement with the outer side surfaces of the AK iron sight assembly.

In one embodiment, the removable rail includes a Picatinney rail.

In another embodiment, each of the pair of brackets further includes a ridge to set a height of the rail above the AK iron sight assembly.

In yet another embodiment, the pressure clamp rotates about a pivot, between a locked and an unlocked position.

In yet another embodiment, the removable rail includes a metal.

In yet another embodiment, the removable rail includes a material selected from the group consisting of steel, cold rolled steel, carbon based steel, and tool steel.

In yet another embodiment, the removable rail includes a steel selected from the group consisting of 4140 steel, 4142 steel, 340 steel, 1144 steel, and 12L14 carbon steel.

In yet another embodiment, the removable rail includes aluminum.

In yet another embodiment, the removable rail includes a surface finish selected from the group consisting of anodized finish, black copper finish, zinc finish, paint finish, cerakote finish, and phosphate coatings.

According to another aspect, a fixed rail for mounting over an AK iron sight assembly of an AK type rifle includes at least one rail having a first end and a second end. A pair of brackets extends from an underside of the first end of the fixed rail forming a rectangular opening adapted to closely fit the outer side surfaces of an AK iron sight assembly. One or more screws extend through a hole in a side of each bracket of the pair of brackets to affix the pair of brackets in a non-moving engagement with the outer side surfaces of the AK iron sight assembly.

In one embodiment, the fixed rail includes a Picatinney rail.

In another embodiment, the one or more screws include a set screw which makes a binding mechanical contact with an unmodified side of the AK iron sight assembly.

In yet another embodiment, each of the pair of brackets further includes a ridge to set a height of the fixed rail above the AK iron sight assembly.

According to yet another aspect, an AK rail for mounting over an AK iron sight assembly of an AK type rifle includes at least one rail having a first end and a second end. A pair of brackets extends from an underside of the first end of the AK rail forming a rectangular opening adapted to closely fit the outer side surfaces of an AK iron sight assembly. At least one shaft extends through a hole in a side of each bracket of the pair of brackets to affix the pair of brackets in a pivotal engagement with existing holes in the outer side surfaces of the AK iron sight assembly.

In one embodiment, the AK rail further includes one or more set screws disposed in a rear top surface of the AK rail which engage a shelf of the AK iron sight assembly to adjust a long axis of the AK rail with a longitudinal axis of an AK barrel of the AK type rifle.

In another embodiment, the AK rail further includes one or more set screws disposed in at least one bracket of the pair of brackets to lock the AK rail into a fixed position on the AK iron sight assembly.

According to yet another aspect, a method for adding a small arms accessory rail system to an AK rifle by mounting a rail over an AK iron sight assembly of an AK type rifle includes providing an accessory rail with side brackets shaped to fit over an AK iron sight of an AK rifle; placing the accessory rail with side brackets over the AK iron sight of the AK rifle; and fixing the accessory rail with side brackets to at least one side of the AK iron sight of the AK rifle.

In one embodiment, the step of fixing includes removably coupling the accessory rail with side brackets to at least one side of the AK iron sight of the AK rifle by a cam and lever assembly.

In another embodiment, the step of fixing includes fixing by pivotal mounting to an existing hole of the AK iron sight assembly.

In yet another embodiment, the step of fixing includes fixing by set screws.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

As described hereinabove, the Picatinney accessory mounting rail for AR type rifles is available in a variety of styles. Accessories which can be mounted on a Picatinney include, for example, advanced sights, and lights, which replace the traditional iron sights. The Picatinney rail style accessory mount is named for the U.S. Army Picatinney Arsenal and has been described in U.S. Military standards, such as MIL-STD-1913 (AR). Other types of rail systems have also been used with AR type rifles. The Otis Patent Trust has described several types of AR rail systems, such as, for example, in U.S. Pat. No. 8,028,460, INTEGRATED RAIL SYSTEM AND METHOD FOR MAKING AND USING SAME, issued Oct. 4, 2011 to Williams The '460 patent is incorporated herein by reference in its entirety for all purposed.

While Picatinney rails are standard and widely available options for AR rifles, generally AK type rifles have not benefited from such rails systems and their associated wide variety of small arms accessories. AK type rifles include the original AK-47 Russian designed (Kalashnikov), the Avtomat Kalashnikova 1947 ("AK-47") as well as similar variant rifles. Unfortunately, the many curved sections, some of them made from wood, are not particularly amenable to conventional small arms rail systems.

As described hereinbelow in detail, it was realized that an accessory rail, such as a Picatinney rail can be made for the AK rifles by mounting it to the sides of the AK iron sight assembly.

Figure 1:
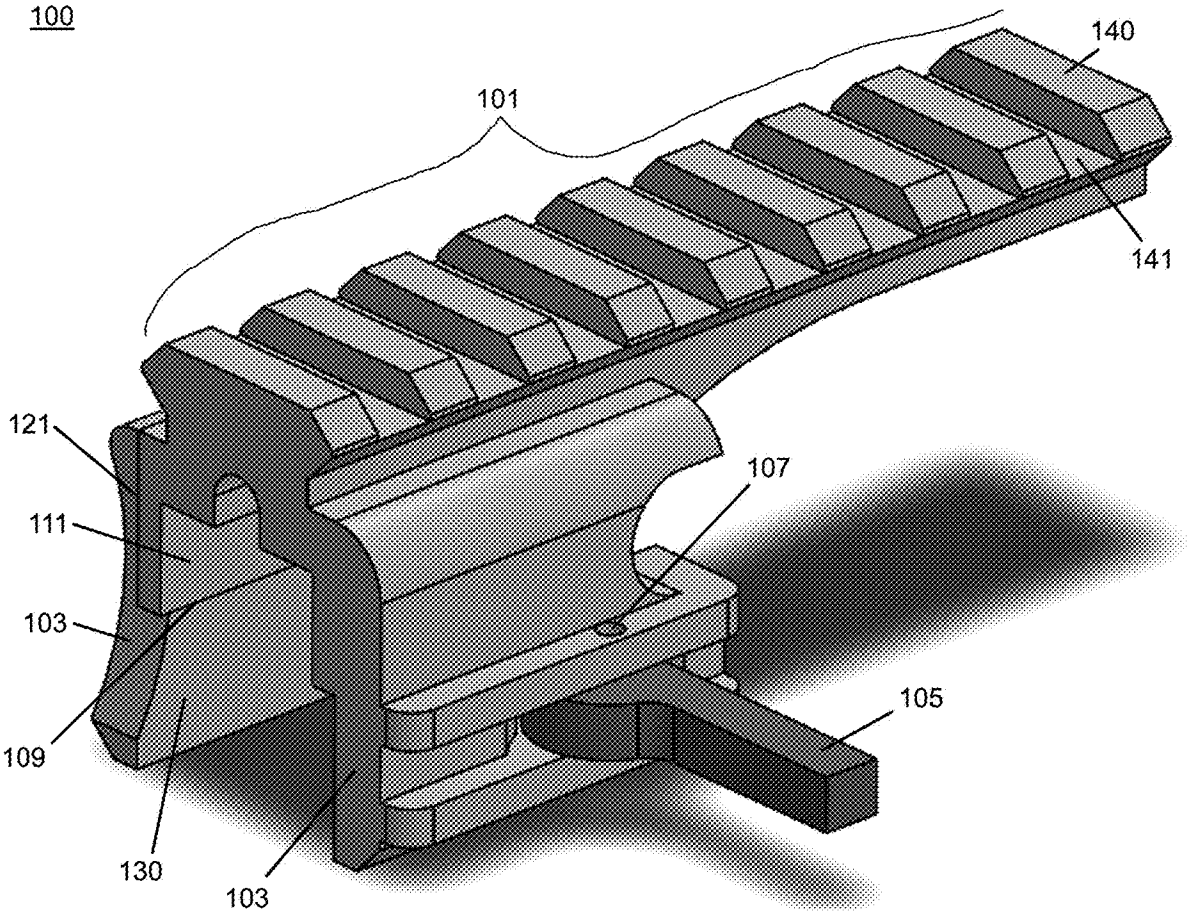
FIG. 1 shows an isometric view of one exemplary embodiment of a removable AK rail.

In one exemplary embodiment, a removable rail FIG. 1, 100, for mounting over an AK iron sight assembly of an AK type rifle includes at least one rail 101 having a first end and a second end. A pair of brackets 103 extend from an underside of the first end of the rail forming a rectangular opening which closely fits the outer side surfaces of an AK iron sight assembly. In the exemplary embodiment of FIG. 1, at least one pressure clamp 105 is disposed on a side of at least one bracket 103 of the pair of brackets wherein when the pressure clamp is in an open position, the pair of brackets can be slid over the AK iron sight assembly for mounting or for removal, and wherein when the pressure clamp is in a closed position, the pair of brackets are held in a non-moving engagement (tightly) with the outer side surfaces of the AK iron sight assembly.

While the Picatinney rail is most popular at present, any suitable rail configuration, including, for example, the Weaver rail, can be used. The rail can be made out of any suitable material, typically a metal, such as, for example, aluminum. It is contemplated that non-metallic materials can be used as well to make the fixed or removable AK rail described herein. The interior sides of the brackets can further include a ridge (e.g. FIG. 1, 109) which can rest on the top surface of the AK iron sight assembly to establish the height of the rail over the AK iron sight assembly.

Figure 9:
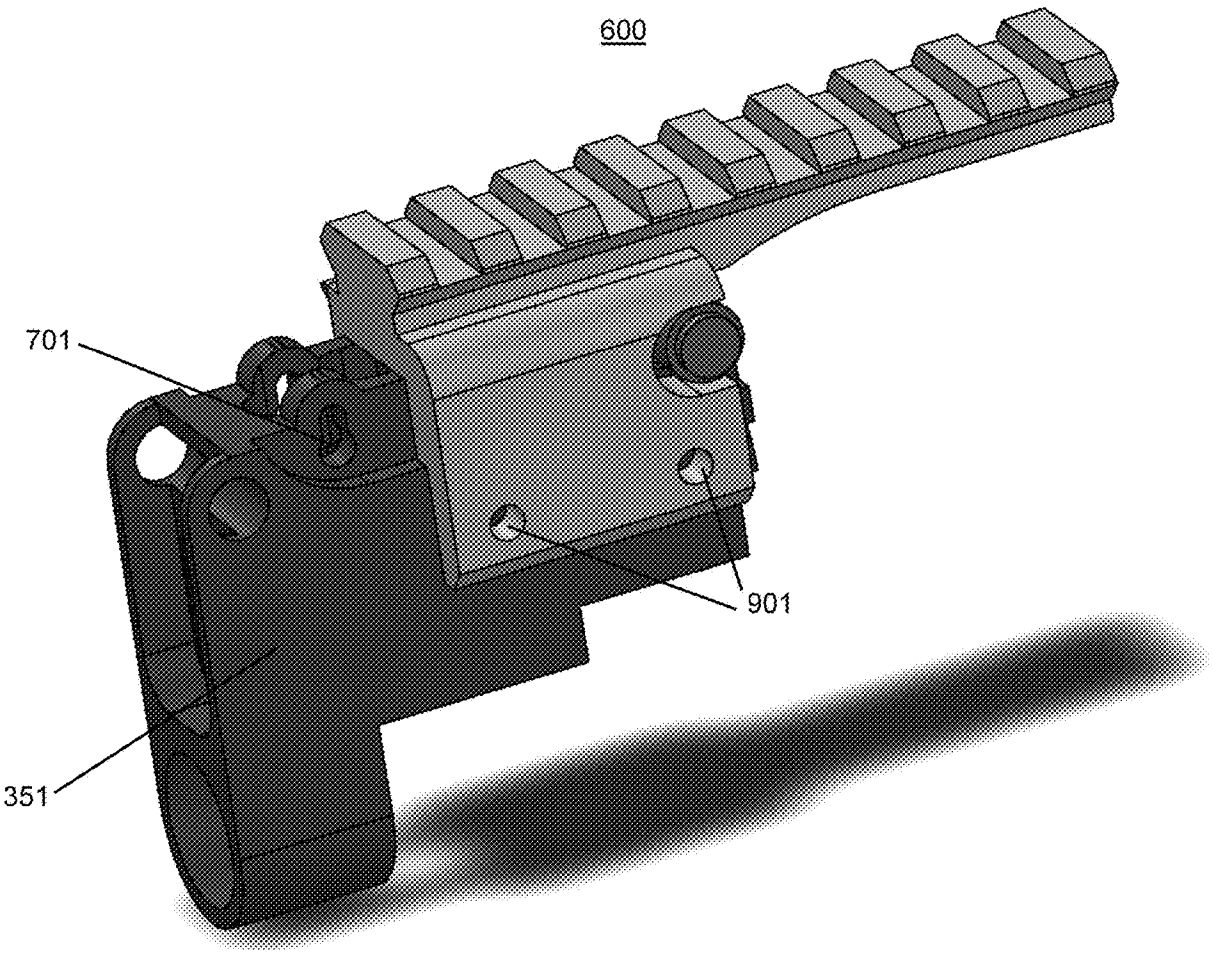
FIG. 9 shows an isometric view of another embodiment of an AK rail, which uses screws to mount AK rail to the AK iron sight assembly.

Several exemplary embodiments of fixed and removable AK rails are now described, including a quick disconnect (FIG. 1), using existing side holes on the rear sight housing (FIG. 5), and set screws which engage the side of the rear sight housing (FIG. 9).

FIG. 1 shows an isometric view of one exemplary embodiment of a quick release removable AK rail 100. Rail 101 can be any suitable rail configuration, typically a Picatinney rail. A plurality of equally spaced transverse ribs 140 can be formed on a portion, a majority, or substantially the entire length of rail 101 separated or interspaced by a plurality of corresponding recesses 141. A pair of brackets 103 form a rectangular opening by bracket interior surfaces 130, adapted to fit the outside surfaces of the AK iron sight assembly (the rear sight housing). In the exemplary embodiment of FIG. 1, a ridge 109 establishes the height of the rail 101 above the AK iron sight assembly. In quick release removable embodiments, such as the AK rail of FIG. 1, a pressure clamp 105 can be used to affix the AK rail to the AK iron sight assembly by a cam and lever action, for example, as pivoted about a pin 107.

The AK rail body including rail 101 and brackets 103 can be, for example, machined or molded from a single work piece block, such as, for example, a block of aluminum. The line 121 on the left side bracket 103 shows how a rail 101 part could be affixed to separate brackets 103 by any suitable joining technology, e.g. screws, glues, welding, etc. The right side bracket shows an exemplary monolithic construction.

Figure 2:
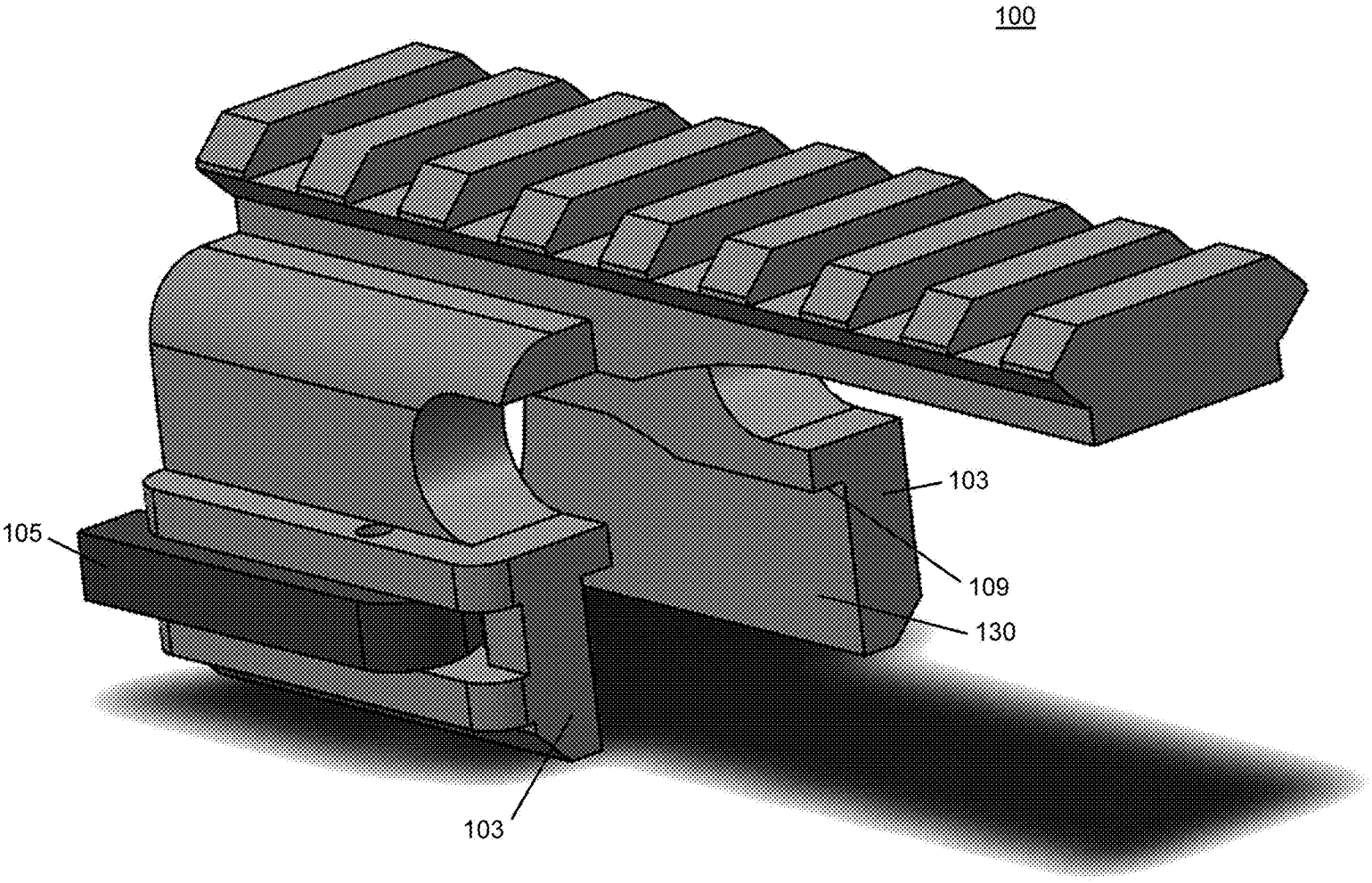
FIG. 2 shows another isometric view of the AK rail of FIG. 1.

FIG. 1 as described herein, shows a quick release removable AK rail 100 where the pressure clamp 105 cam and lever action is shown in a released or open position. FIG. 2 shows the AK rail of FIG. 1 where the pressure clamp 105 cam and lever action is in a clamped or closed position.

Figure 3:
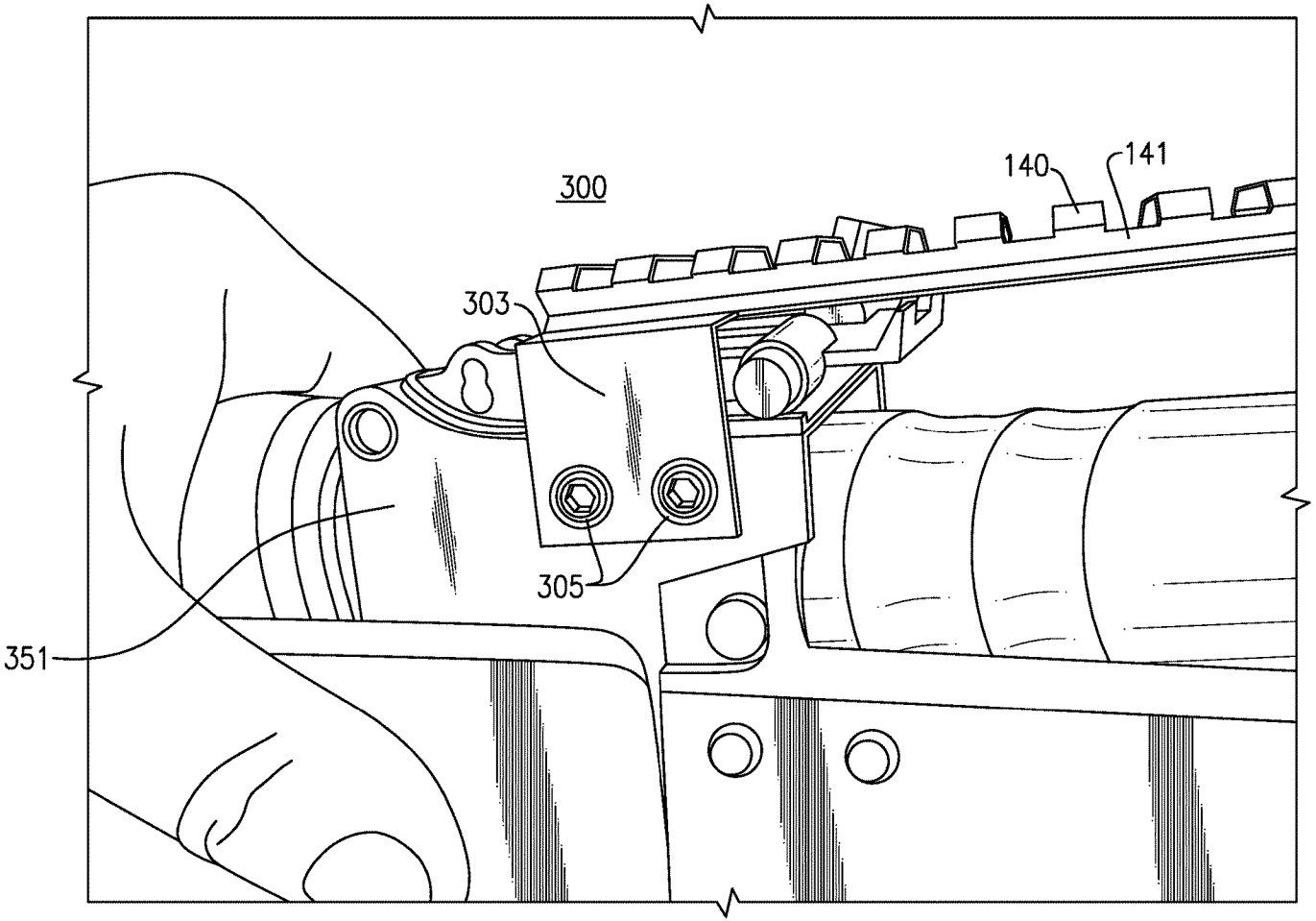
FIG. 3 shows a side view of a fixed mounted AK rail.

FIG. 3 shows a different embodiment of an AK rail 300 where the AK rail side brackets 303 are bolted to the side 351 of the AK iron sight assembly. In the exemplary embodiment of FIG. 3, screws 305 (e.g. machine screws or set screws) are used to affix each side bracket 303 of the AK rail 300 to the iron sight assembly. Any suitable number of any suitable fastener can be used to fix AK rail 300 to the sides 351 of the AK iron sight assembly. Corresponding suitable threaded holes could be added to the sides of the AK iron sight assembly, or more conveniently, as described in more detail hereinbelow, screws such as set screws, can be used to hold the brackets in fixed contact with the unmodified sides of the AK iron sight assembly.

Ridges (not visible in FIG. 3) on the interior sides of brackets 303 can be used to establish the height of the rail 101 above the AK iron sight assembly. The exemplary AK rail 300 of FIG. 3 was machined from aluminum. However, an AK rail 300 can be made from any suitable metallic or non-metallic material by any suitable manufacturing process.

Figure 4:
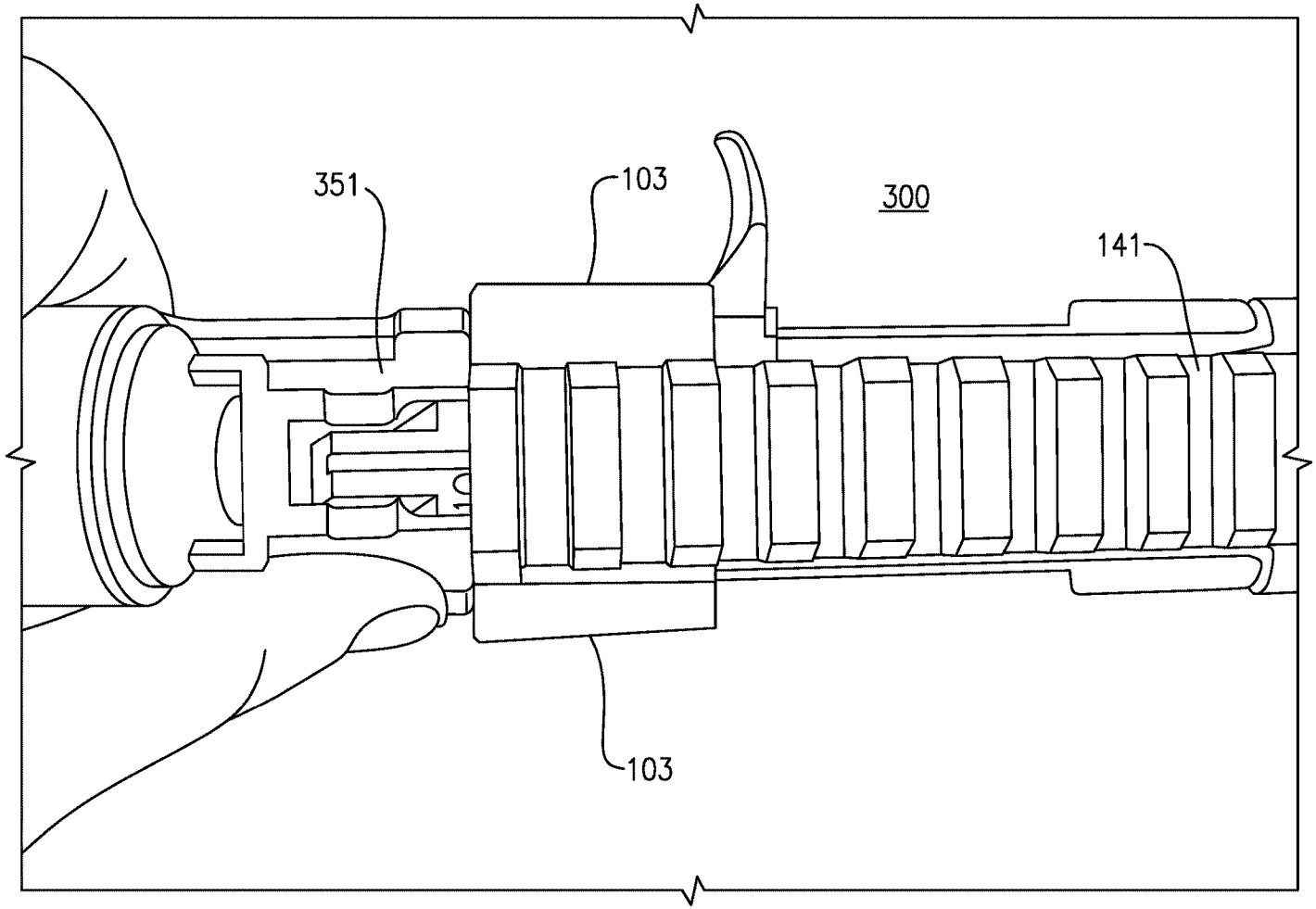
FIG. 4 shows a top view of the AK rail of FIG. 3.

FIG. 4 shows a top view of the AK rail 300 of FIG. 3.

Figure 5:
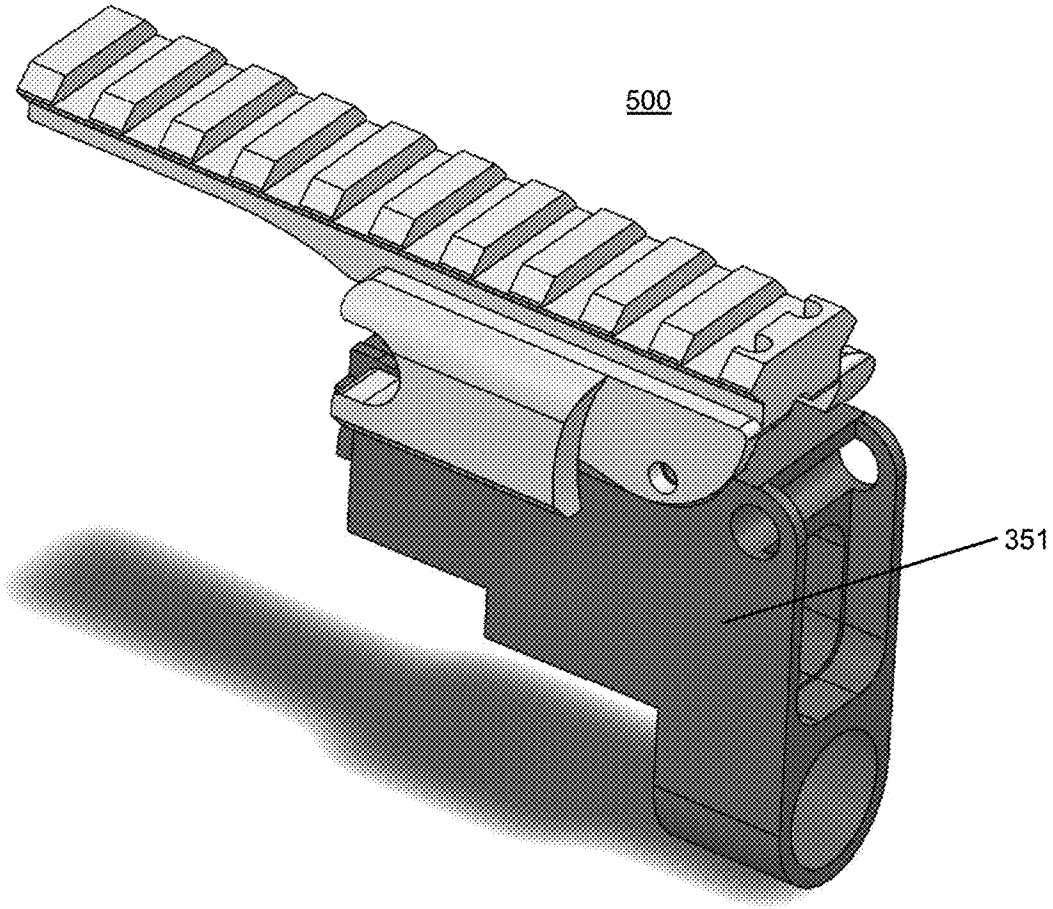
FIG. 5 shows an isometric view of another embodiment of an AK rail, which mounts to the AK rifle using side holes on AK iron sight assembly.
Figure 6:
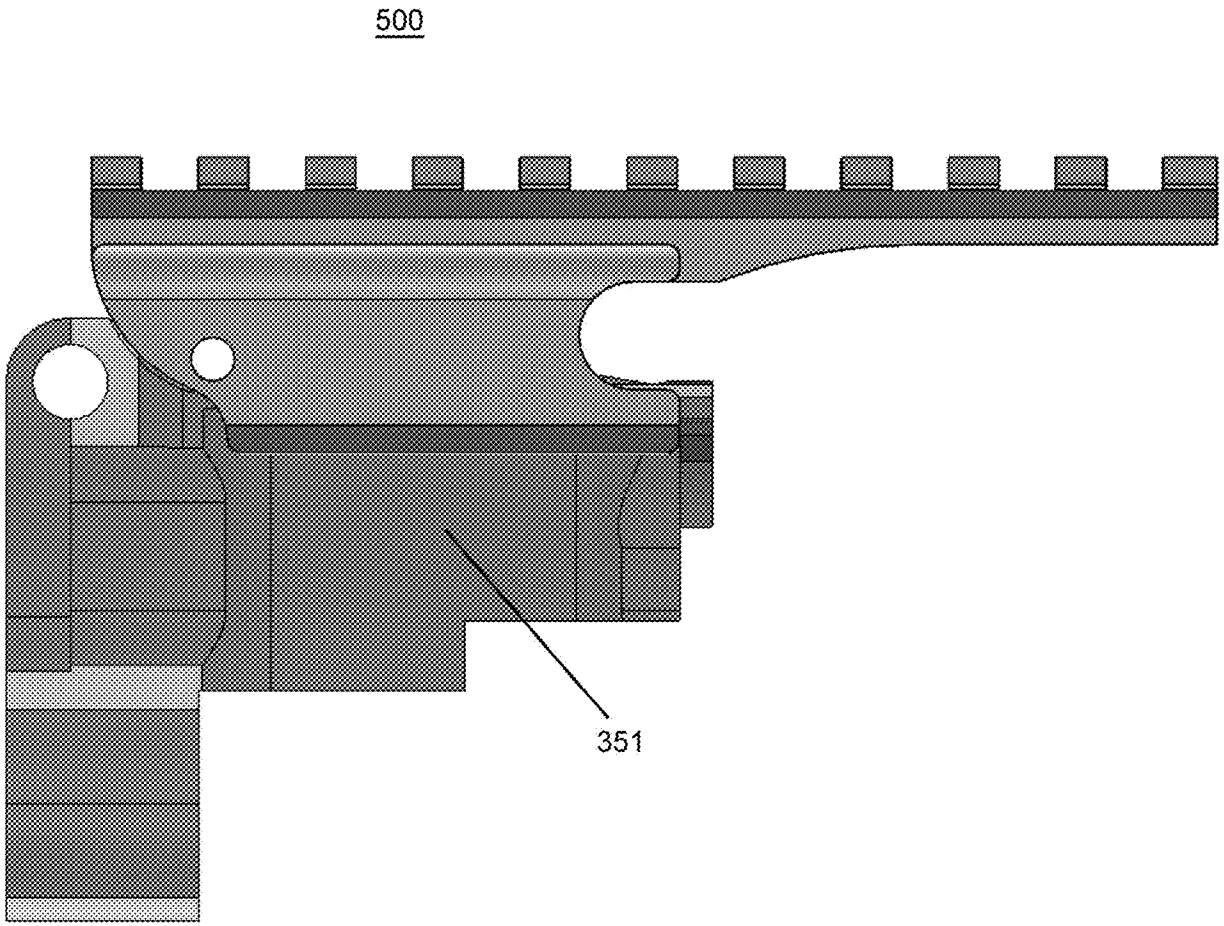
FIG. 6 shows a side view of the AK rail of FIG. 5.

FIG. 5 shows an isometric view of another embodiment of an AK rail 500, which uses the side holes on AK iron sight assembly 351 to mount the AK rail. FIG. 6 shows a side view of the AK rail of FIG. 5.

Figure 7:
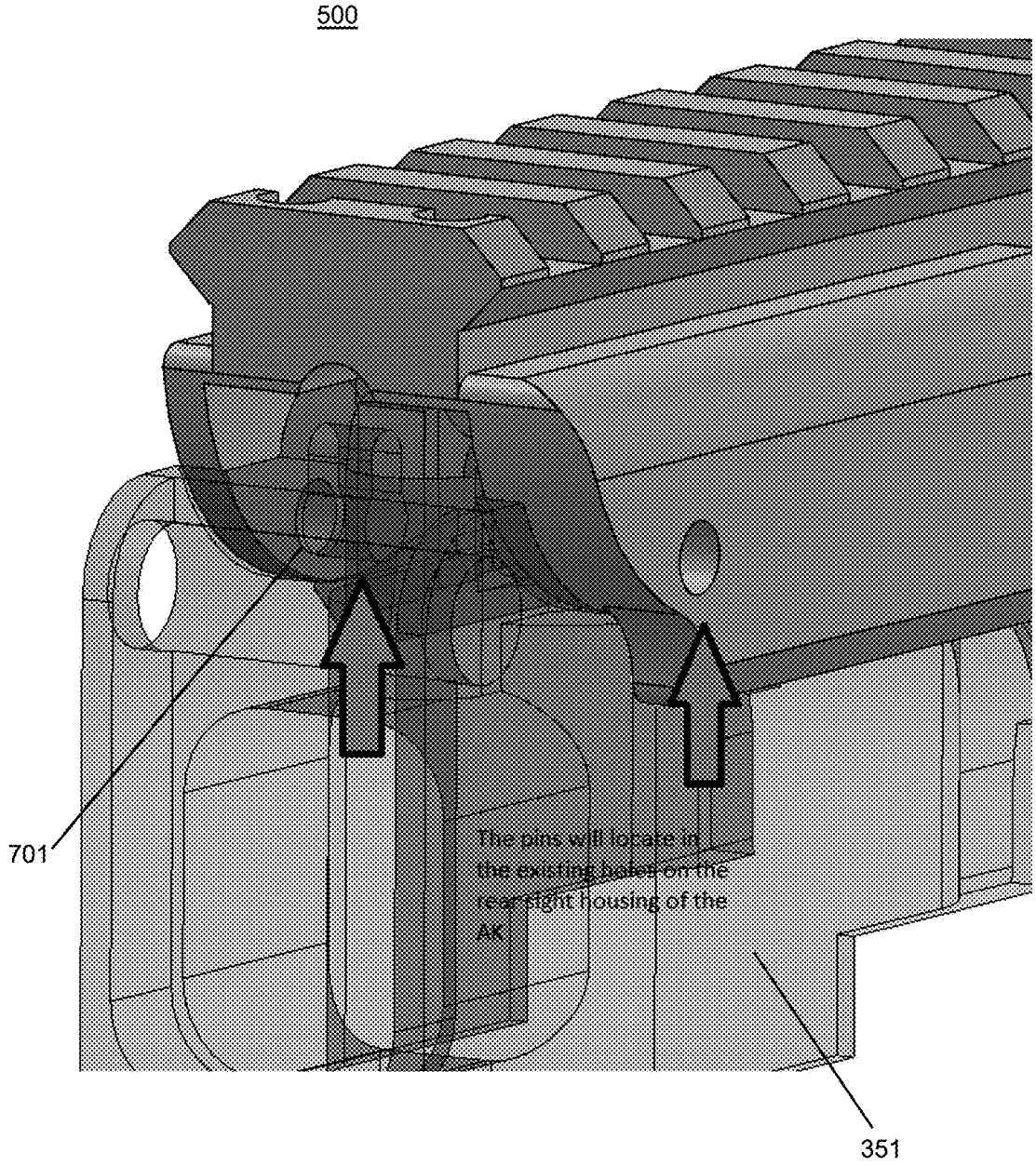
FIG. 7 shows a rear angled view of the AK rail of FIG. 5.

FIG. 7 shows a rear angled view of the AK rail of FIG. 5 where the AK iron sight assembly is partially transparent to show the existing AK iron sight assembly mounting hole 701.

Figure 8:
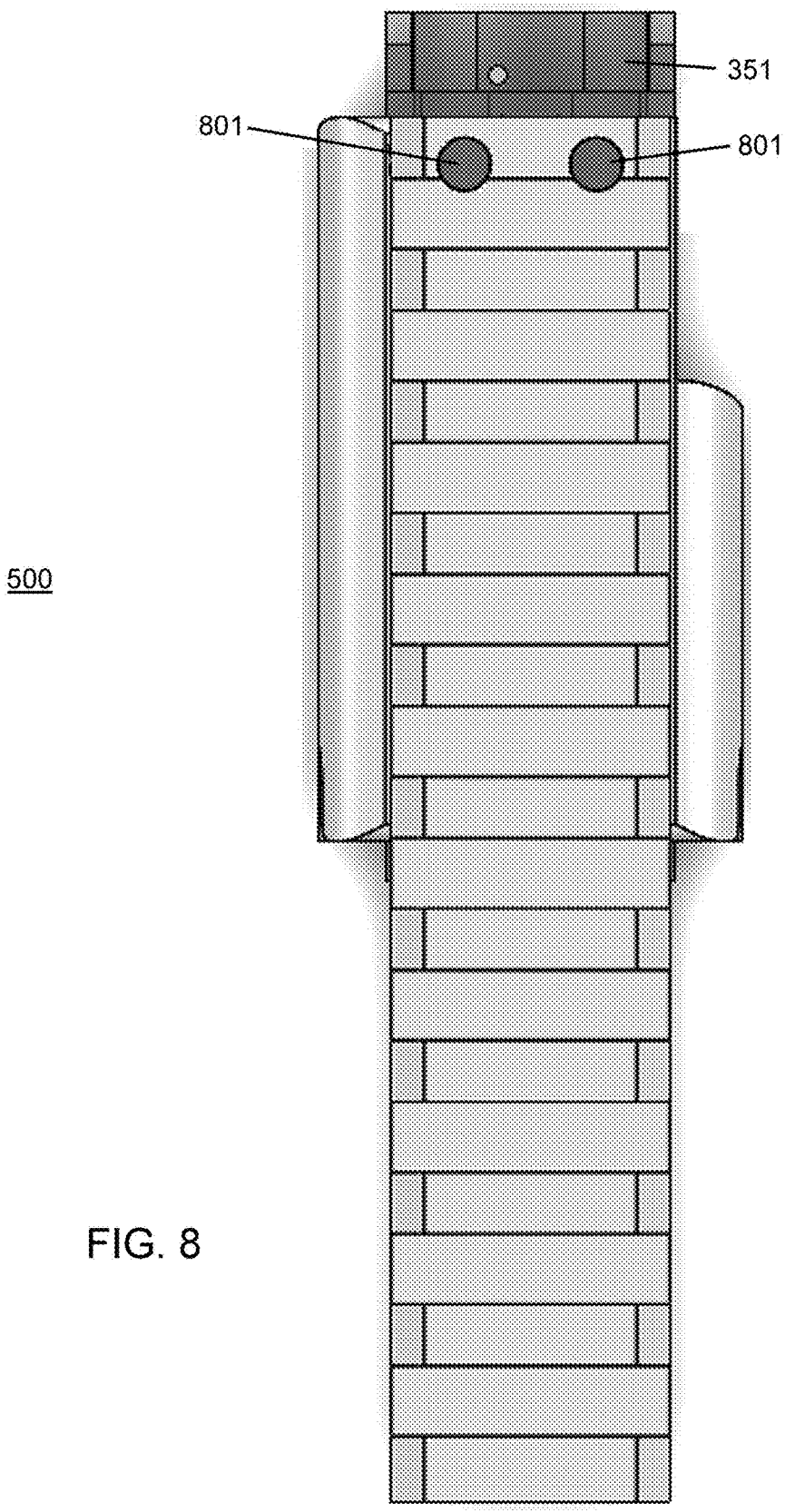
FIG. 8 shows a top view of the AK rail of FIG. 5.

FIG. 8 shows a top view of the AK rail of FIG. 5. Set screws can be used, such as can be mounted in threaded holes 801 which can rest on an upper ledge of the AK iron sight assembly 351. The set screws can be adjusted to cause a rotation or pivoting movement of the AK rail about the side holes 701 on AK iron sight assembly 351, such as to level and align the AK rail with the long axis of the barrel of the AK rifle.

FIG. 9 shows an isometric view of another embodiment of an AK rail 900, which uses four screws, such as set screws (e.g. Allen set screws), in threaded holes 901 to mount the AK rail to the side of the AK iron sight assembly 351. The set screw drive type, such as, for example, straight slot, hex socket (e.g. Allen), square socket, or Bristol spline, is unimportant. Some suitable set screws include a relatively sharp tip or sharp circle to capture or "bite" into a surface, such as, for example, a relatively sharp edged cup, knurled cup point, or conical tip. Other suitable set screws can positively engage a surface by friction contact, such as, for example, an oval tip, dog tip, or a flat tip. The set screws can be used to affix an AK rail 900 to the sides of the AK iron sight assembly 351 without adding corresponding holes or dimples to the side surfaces of the AK iron sight assembly 351.

In alternative mounting schemes, corresponding dimples or holes could be added to the side of the AK iron sight assembly 351. Also, alternatively, there could be corresponding holes and/or threaded holes added to the sides of the AK iron sight assembly 351 where the holes 901 of an AK rail 900 are threaded or not. While such alternative side screw mounting schemes can be used, set screws which "bite into" or otherwise make a firm positive friction contact with the sides of the AK iron sight assembly 351 is a more convenient mounting technique because there is no need to drill holes into the sides of the original AK iron sight assembly 351.

Figure 10:
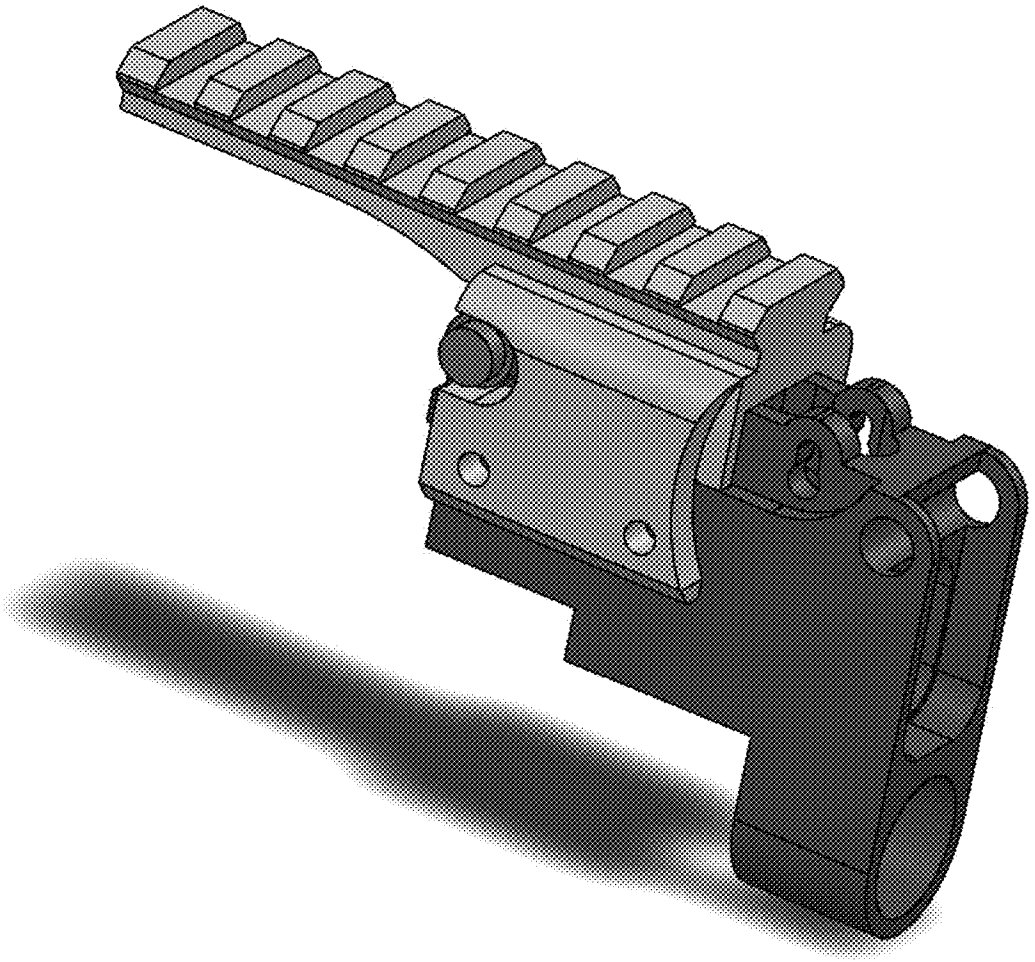
FIG. 10 shows another isometric view of the AK rail of FIG. 9.
Figure 11:
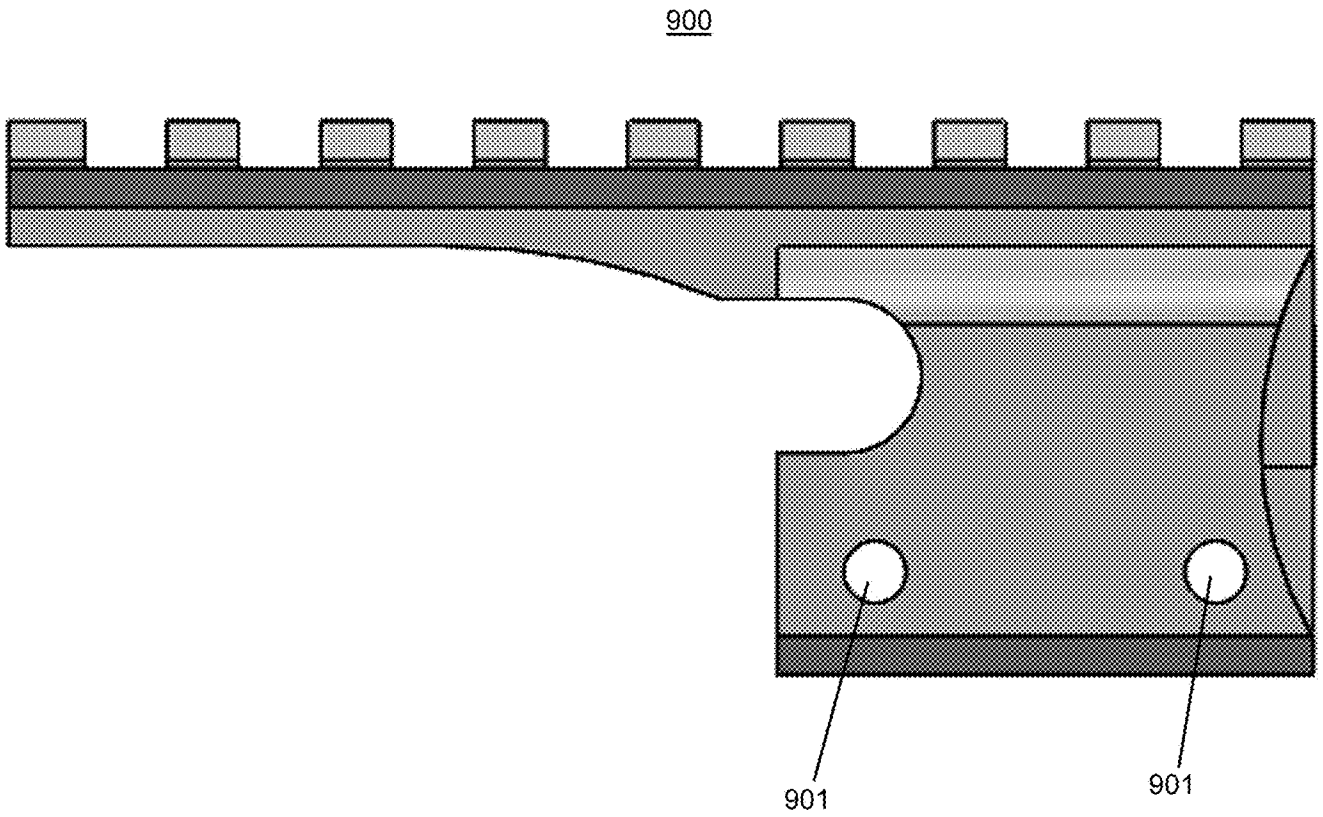
FIG. 11 shows a side view of the AK rail of FIG. 9.
Figure 12:
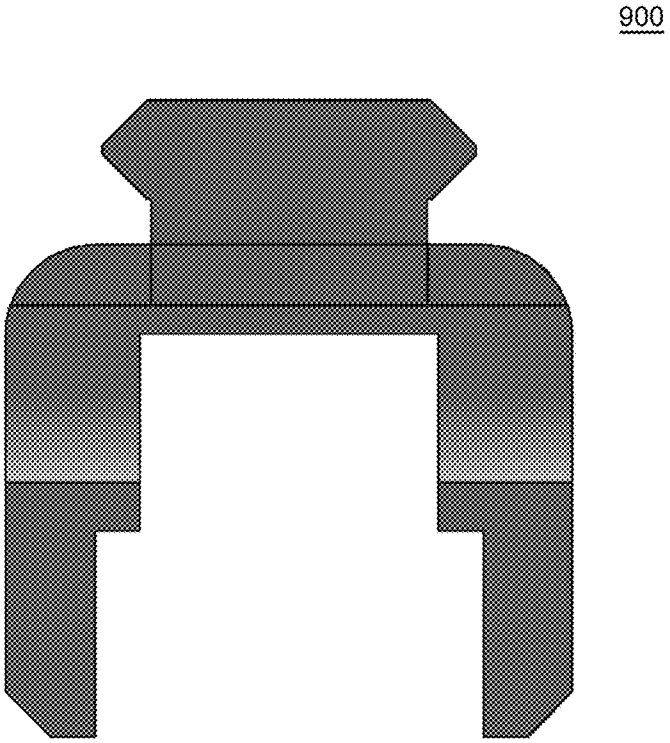
FIG. 12 shows an end view of the AK rail of FIG. 9.

FIG. 10 shows another isometric view of the AK rail of FIG. 9. FIG. 11 shows a side view of the AK rail of FIG. 9. FIG. 12 shows an end view of the AK rail of FIG. 9.

Combinations of AK rail mounting techniques as described hereinabove can also be made. For example, there could be a pivot mounted AK rail of FIG. 5 combined with one or more of the side set screws of FIG. 9.

AK rails as described hereinabove can be made from any suitable metal, such as steel or aluminum. For example, an AK rail can be made from a 4140/4142/340, 1144 Steel for the main rail body and in the case of the clamp embodiment (e.g. FIG. 1), tool steel for the friction clamp. Suitable materials include cold roll steel, Aluminum, 12L14, carbon based steel, and tool steel. Typically an AK rail will be machined out of billet. Molding processes may be less desirable because of desired manufacturing tolerances and stability for a precision small arms accessory rail. Alternative manufacturing techniques could include, for example, multiple parts welded or bolted together with fasteners. Exemplary suitable surface finishes include an anodized finish, black copper finish, zinc finish, paint finish, cerakote finish, and phosphate coatings.

While AK rifles are somewhat less standardized than some rifle types such as the AR-15, the exemplary embodiments of AK rails described hereinabove have been found to fit most AK rifles. It will be understood by those skilled in the art that relatively minor modifications may be made to fit an AK rail as described hereinabove to similar, but slightly different AK iron sight assemblies.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A fixed accessory rail for mounting over an AK iron sight assembly comprising:

an accessory rail having a first end comprising two threaded holes in a first surface of said accessory rail at about said first end along an axis perpendicular to a longitudinal axis of said accessory rail, and a second end rearward of said first end, a first side, and a second side;

a pair of setscrews disposed in said two threaded holes in said first surface of said accessory rail;

a first bracket, physically integral to and extended downward from said first side of said accessory rail comprising:

a curved wall disposed in a first bracket side wall defining a C-shaped opening disposed in a rearward end of said first bracket;

a first bracket threaded hole disposed in said first bracket side wall forward of said C-shaped opening and rearward of said two threaded holes in said first surface of said accessory rail; and a first bracket ridge disposed on an interior wall of said first bracket;

a first bracket setscrew pin threadingly engaged said first bracket threaded hole;

a second bracket, physically integral to and extended downward from said second side of said accessory rail comprising:

a curved wall disposed in a second bracket side wall defining a C-shaped opening disposed in a rearward end of said second bracket;

a second bracket threaded hole disposed in said second bracket side wall forward of said C-shaped opening and rearward of said two threaded holes in said first surface of said accessory rail; and a second bracket ridge disposed on an interior wall of said second bracket;

a second bracket setscrew pin threadingly engaged said second bracket threaded hole; and wherein said accessory rail, said first bracket, and said second bracket comprise a fixed accessory rail as a single one-piece body structure comprising a common material.

2. The fixed accessory rail of claim 1, wherein each of said C-shaped opening provides a clearance for a side of an AK iron sight assembly cylindrical slider.

3. The fixed accessory rail of claim 1, wherein both of said first bracket setscrew pin and said second bracket setscrew pin comprise a dog tip setscrew.

4. The fixed accessory rail of claim 1, wherein both of said first bracket setscrew pin and said second bracket setscrew pin provide a pivot point.

5. The fixed accessory rail of claim 1, wherein said first bracket ridge and said second bracket ridge contact a surface edge of an existing AK iron sight to lock said fixed accessory rail to said existing AK iron sight.

6. The fixed accessory rail of claim 1, wherein said pair of setscrews comprise a dog tip setscrew.

7. The fixed accessory rail of claim 1, further comprising an additional set screw disposed in a threaded hole in a forward portion of at least either of a first bracket side wall or a second bracket side wall.

8. The fixed accessory rail of claim 7, wherein said additional set screws comprise a dog tip setscrew or a flat tip setscrew.

9. The fixed accessory rail of claim 1, wherein either of said first bracket or said second bracket further comprise a forward cutout section of an end of said first bracket or said second bracket opposite to said C-shaped opening.

10. The fixed accessory rail of claim 9, wherein said forward cutout section provides a clearance for an AK iron sight assembly lock lever.

11. The fixed accessory rail of claim 1, wherein said fixed accessory rail comprises a metal.

12. The fixed accessory rail of claim 11, wherein said metal comprises aluminum.

13. The fixed accessory rail of claim 11, wherein said metal comprises a material selected from the group consisting of steel, cold rolled steel, carbon based steel, and tool steel.

14. The fixed accessory rail of claim 1, wherein said fixed accessory rail comprises an anodized finish.

15. The fixed accessory rail of claim 1, wherein said fixed accessory rail comprises a surface finish selected from the group consisting of black copper finish, zinc finish, paint finish, cerakote finish, and phosphate coatings.

16. The fixed accessory rail of claim 1, wherein said fixed accessory rail comprises a Picatinney rail.

* * * * *